US005971360A

United States Patent [19]

Sinsley

[11] Patent Number: 5,971,360

[45] Date of Patent: Oct. 26, 1999

[54] LIFTING APPARATUS FOR LAWN MOWER EQUIPMENT

[76] Inventor: Wayne Sinsley, 4255 Depot Rd., Salem, Ohio 44460

[21] Appl. No.: 09/198,631

[22] Filed: Nov. 24, 1998

[51] Int. Cl.[6] ..... B66F 7/22

[52] U.S. Cl. ..... 254/8 B; 254/131; 254/134

[58] Field of Search ..... 254/131, 133, 254/134, 100, 8 R, 8 B

[56] References Cited

U.S. PATENT DOCUMENTS 2,463,305 3/1949 Poor et al. .
2,744,762 5/1956 Kirk .
4,113,235 9/1978 Hartman, Jr. .
5,000,423 3/1991 Snickers .
5,678,804 10/1997 Lintelman et al. .
5,713,557 2/1998 Kang .
5,716,061 2/1998 Sloan et al. ..... 254/131

*Primary Examiner*—Robert C. Watson
*Attorney, Agent, or Firm*—Harpman & Harpman

[57] ABSTRACT

A lifting and support device for elevating self-propelled lawn mowers or lawn tractors comprising, a support frame having wheels with adjustable equipment engagement and stabilization brackets extending therefrom. An activation bar handle extending from said support frame in an angular relation thereto so that the elevated lawn mower equipment moves past a vertical lift line for stabilization.

15 Claims, 5 Drawing Sheets

LIFTING APPARATUS FOR LAWN MOWER EQUIPMENT

BACKGROUND OF THE INVENTION

1. Technical Field

This device relates to lifting jacks and levers for powered lawn mowing equipment that lifts one end of the equipment up for servicing and cleaning.

2. Description of Prior Art

Prior art devices of this type address the problem of servicing and cleaning self-propelled riding type lawn mowers or lawn tractors. This type of lawn mowing equipment is quite heavy and cannot be easily lifted which is often required in the servicing of the associated power mowing decks for cleaning, blade replacement or sharpening.

Heretofore it was necessary to manually lift the front end of the mower or tractor up onto temporary service blocks to provide sufficient clearance for access under the mowing deck of the equipment. A number of prior art lifting stands have been developed in an attempt to address this problem, see for example U.S. Pat. Nos. 2,463,305, 2,744,762, 4,113,235, 5,000,423, 5,678,804 and 5,713,557.

In U.S. Pat. No. 2,463,305 a tractor jack is disclosed having an axle engagement stand which uses the hydraulic power unit of the tractor to engage and lift itself by the back wheels.

U.S. Pat. No. 2,744,762 is directed to a hand operated lifting device similar to a conventional hand dolly having a pair of wheels, a handle frame extending from an axle and a pair of bi-laterally extending lifting forks.

U.S. Pat. No. 4,113,235 is a lever action lift jack for motorcycles having a transverse support bar with tubular handles extending for lifting.

U.S. Pat. No. 5,000,423 shows a small vehicle lift having a self-supporting lift stand with a pivoted multi-lever lift assembly extending therefrom. The lift assembly has flexible towing straps engageable on the wheel axles of the equipment so as to pull the equipment up parallel inclined ramps to a level support surface.

U.S. Pat. No. 5,678,804 shows a jacking device for lawn mowing equipment having an equipment gripping jaw extending from a wheeled support assembly and engagement handles.

Finally, U.S. Pat. No. 5,713,557 is directed to a vehicle jack having a central vehicle engagement post that is adjustable. The post has a pair of support wheels and a lift handle extending therefrom.

SUMMARY OF THE INVENTION

An adjustable lifting and support device for riding lawn mowers and the like having a main support frame with wheels thereon. Adjustable equipment engagement arms extend from the support frame for registration with the wheels of the lawn equipment. A central lifting handle extends from the support frame to lift and then stabilize the equipment in elevated position.

DESCRIPTION OF THE PREFERRED EMBODIMENT

Figure 1:
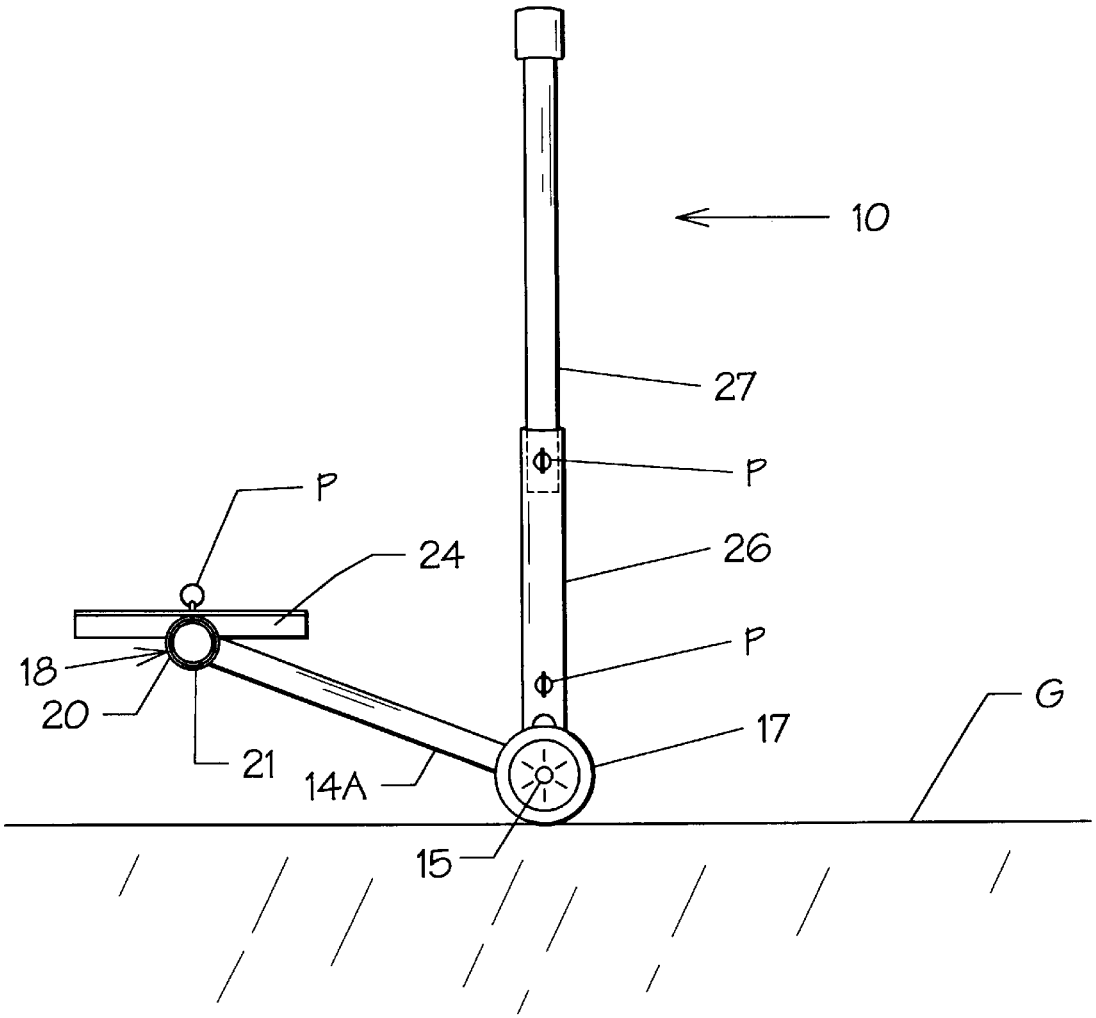
FIG. 1 is a side elevational view of the lifting device of the invention.
Figure 2:
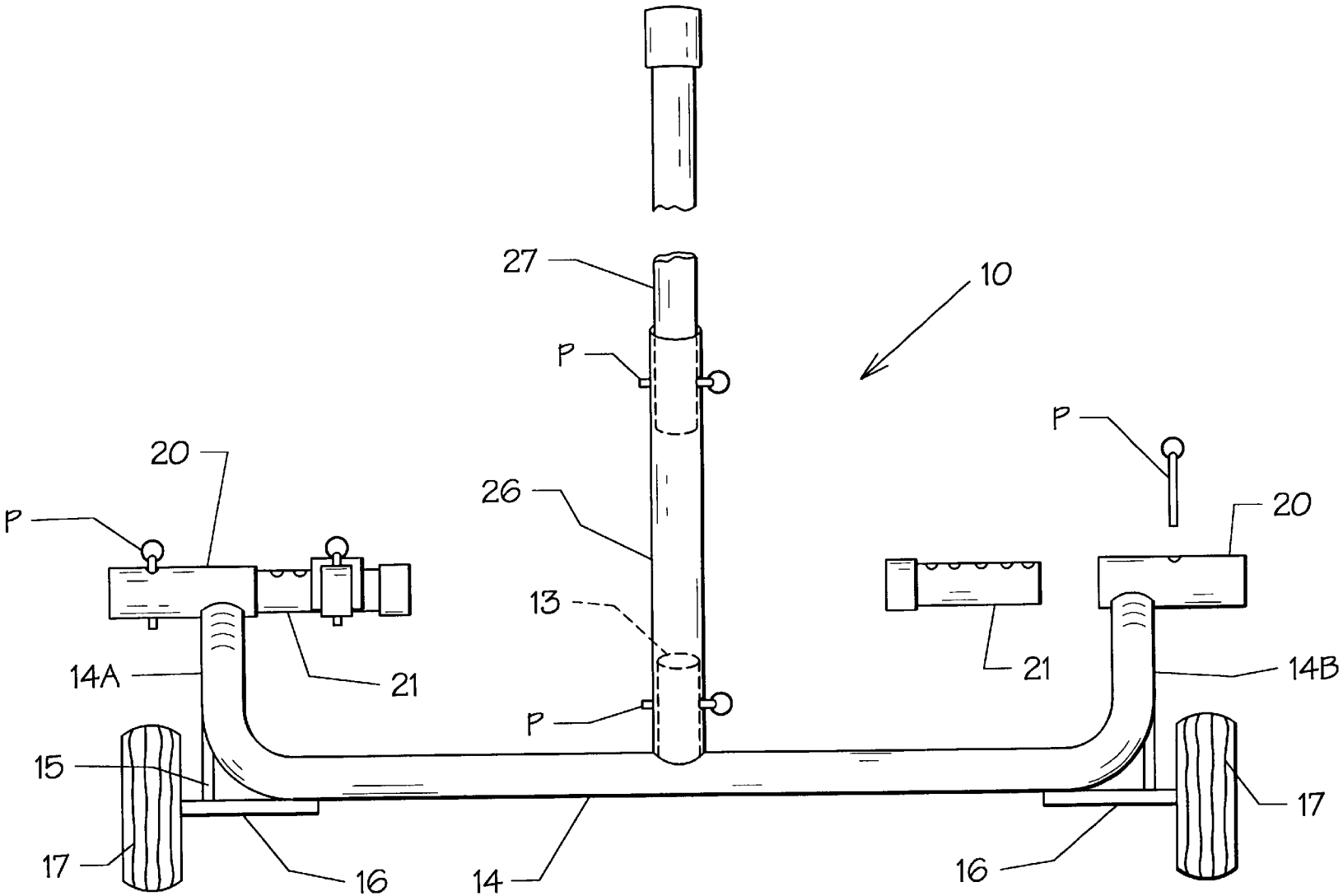
FIG. 2 is an end plan view of the invention with portions broken away and exploded for detail.
Figure 3:
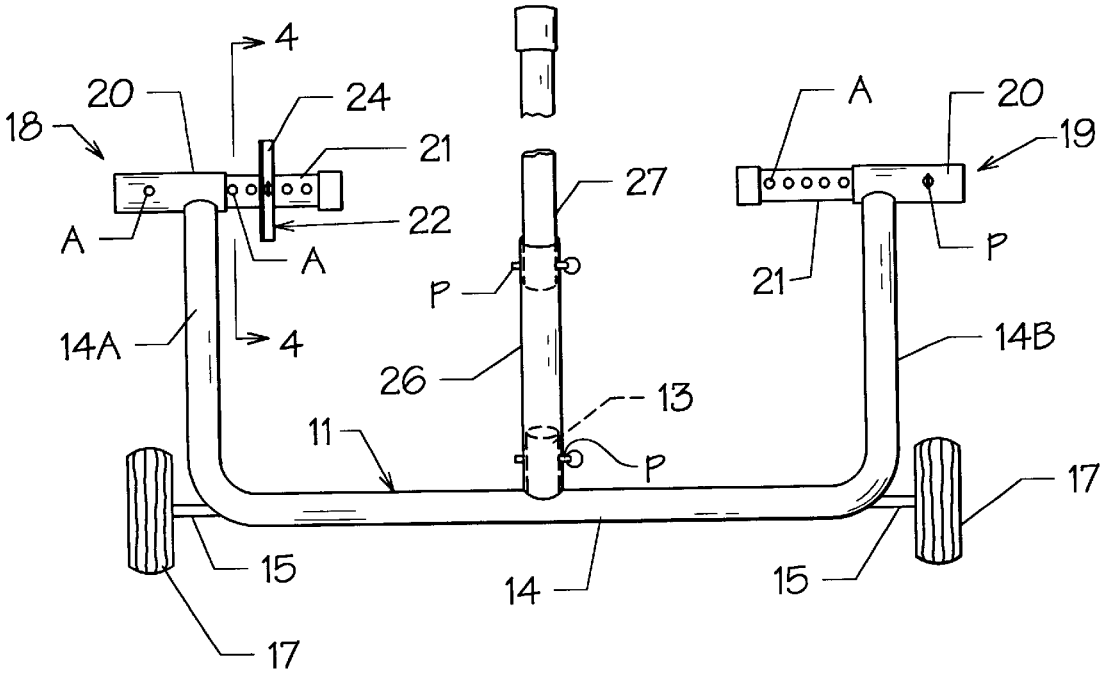
FIG. 3 is a top plan view of the lifting device of the invention.

Referring to FIGS. 1, 2, 3, 5 and 6 of the drawings, a lifting device 10 can be seen for lifting lawn mowing equipment 10A for servicing and routine cleaning. The lifting device 10 has a main tubular support frame 11 having a generally U-shape configuration. The support frame 11 is composed of a U-shaped frame element having a handle fitting 13 extending therefrom, best seen in FIG. 2 of the drawings. The frame element has a horizontal support portion 14 and associated equipment support portions 14A and 14B extending therefrom. The horizontal support portion 14 has a pair of oppositely disposed wheel assemblies thereon each comprising an axle rod 16 secured by welding thereto with a brace 15. Wheels 17 are rotatably positioned on the free ends of said respective axle rods 16 as will be well understood by those skilled in the art. Adjustable wheel equipment assemblies 18 and 19 are positioned on the respective free ends of the equipment support portions 14A and 14B as best seen in FIGS. 2 and 3 of the drawings.

The wheel equipment assemblies 18 and 19 have mounting tubes 20 which are secured to the respective ends of the equipment support portions 14A and 14B at right angles thereto. Extension tubes 21 are selectively positioned within and extend from the respective mounting tubes 20 and have a plurality of longitudinally spaced apertures A therein. Locking pins P extend through selected aligned apertures A in the mounting tube 20 for aligned registration with the selective longitudinally spaced aligned apertures A in the extension tubes 21 for securing same within.

Figure 4:
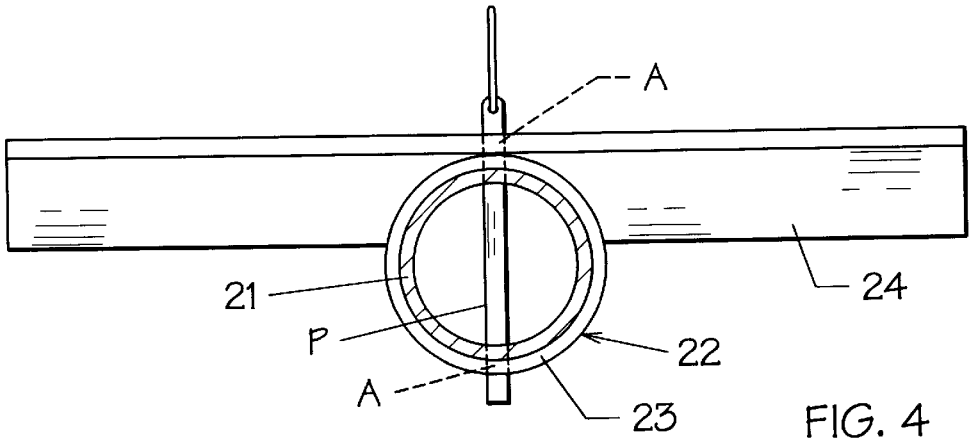
FIG. 4 is an enlarged cross-sectional view on lines 4—4 of FIG. 3 showing a stabilization fitting on the invention.
Figure 5:
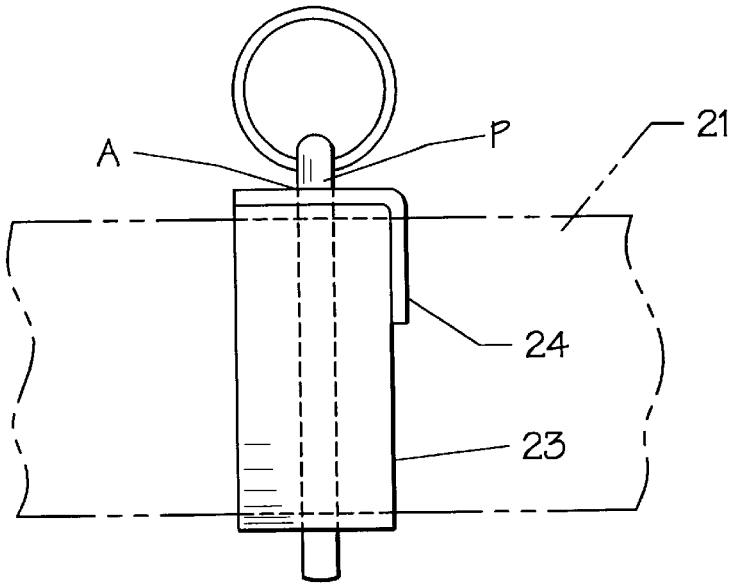
FIG. 5 is an enlarged end plan view of the stabilization fitting illustrated in FIG. 4 on a portion of the invention shown in broken lines.
Figure 6:
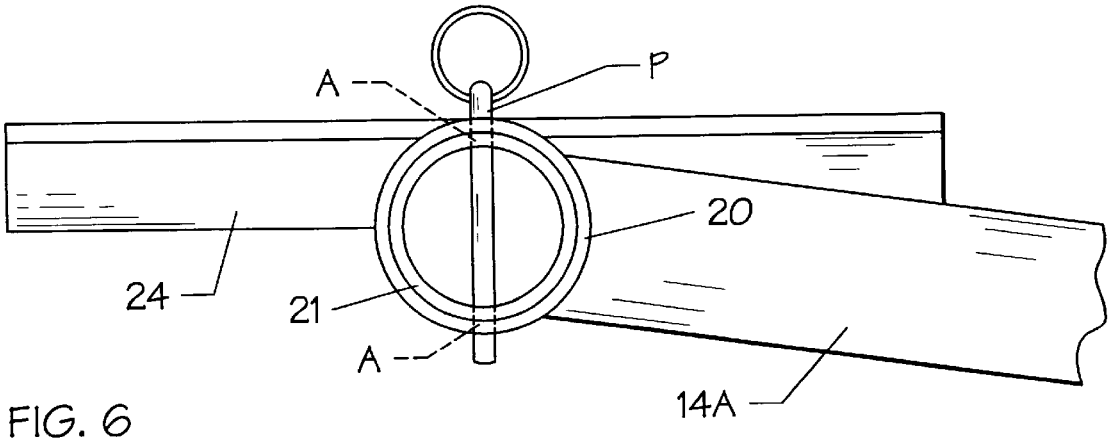
FIG. 6 is an enlarged partial view of the equipment engagement fittings and stabilization fitting on the invention.

Referring now to FIGS. 4 and 5 of the drawings, an equipment wheel stabilizer 22 can be seen, having a mounting sleeve 23 with an angle iron section 24 secured thereto. The stabilizer 22 has an aligned aperture A therethrough and is engageable over one of the respective extension tubes 21 and selectively secured thereto by locking pin P extending through the selected longitudinally spaced aligned apertures A therein.

Figure 7:
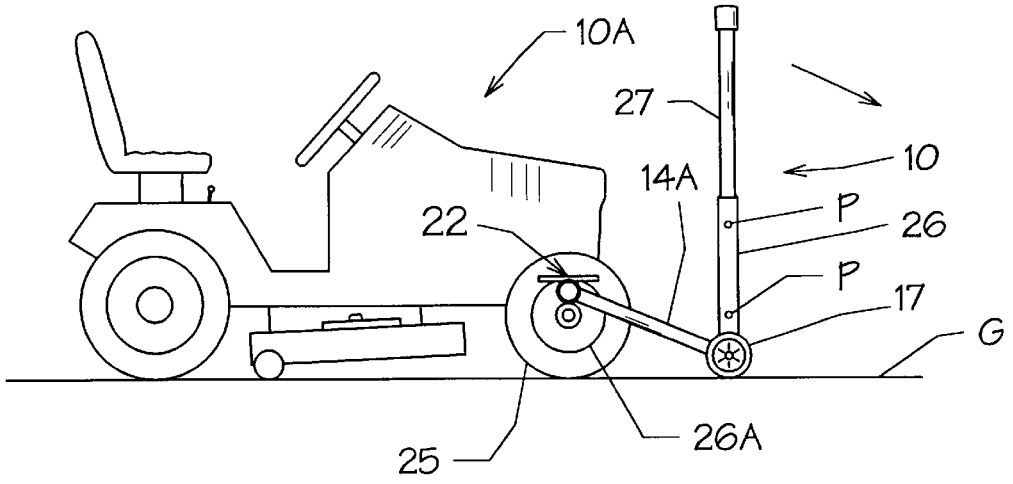
FIG. 7 shows a side view of the lifting device of the invention initially engaged on mowing equipment prior to lift.
Figure 8:
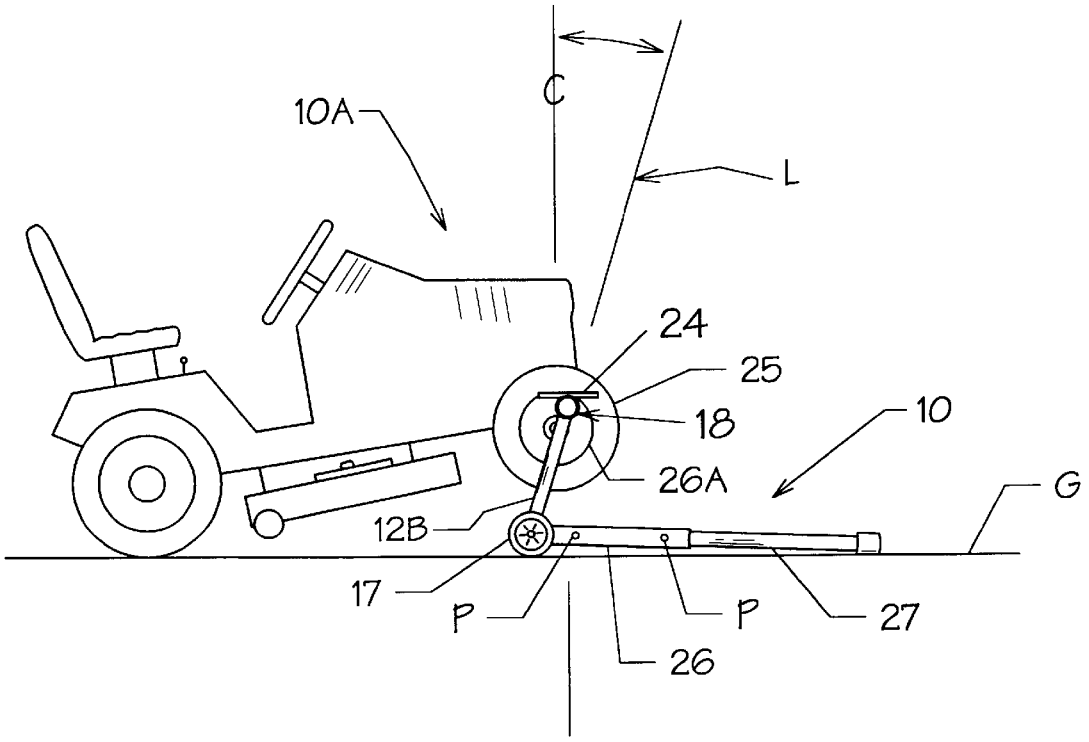
FIG. 8 is a side elevational view illustrating the lifting device of the invention fully engaged and lifting mowing equipment.

It will thus be seen that the lift device 10 of the invention is of an overall generally L-shape configuration with the oppositely disposed equipment support portions 14A and 14B and their respective extension tubes 21 being engageable with front wheels 25 of the lawn mowing equipment 11 as best seen in FIGS. 7 and 8 of the drawings.

As described above, each of the respective extension tubes 21 can be incrementally advanced from within its respective support tube 20 and locked in position against wheel hubs 26 of the respective wheels 25 by the locking pins P. The stabilizer 22 is positioned on one of the extension tubes 21 are then advanced for registration against the wheel 25 and locked in place by locking pins P through the respective aligned apertures A as hereinbefore described.

The handle fitting 13 has a mounting sleeve 26 that is registerable over the handle fitting 13 and extends the coupling sleeve selectively secured thereto by aligned apertures therethrough and locking pins P. An elongated handle 27 is registerably positioned within the mounting sleeve 26 and secured by a locking pin P extending through multiple aligned apertures within the sleeve 26 and elongated handle 27 which will be well understood by those skilled in the art.

Referring now to FIGS. 7 and 8 of the drawings, it will be seen that once the lifting device 10 of the invention is engaged against the outside hub 26 of the wheel 25 and the stabilization fitting 22 is locked in position against the wheel 25, the elongated handle 28 is then pulled downwardly as indicated by directional arrow in FIG. 7 of the drawings and lifts the lawn mower equipment 10A as illustrated in FIG. 8 of the drawings. It will also be apparent that due to the angular inclination between the equipment engagement portions 14A and 14B and the handle portion 27 which is less than 90 degrees that once elevated the front wheels 25 are therefore positioned past a "vertical lift" point as indicated by center lines C and lift line L and become stable and self-supporting with the handle 27 positioned on the ground G.

The stabilizer 22 keeps the front wheels 25 from turning during the "lift" helping to maintain engagement with the extension tubes 21 as hereinbefore described. It will be evident from the above description that the lift device 10 of the invention can accommodate a wide range of different lawn mower equipment configurations by the adjustability of the respective extension tubes 21 to meet the differing widths of wheel assemblies on such varied equipment.

It will thus be seen that a new and novel mower lifting device has been illustrated and described and it will be apparent to those skilled in the art that various changes and modifications may be made therein without departing from the spirit of the invention.

Therefore I claim:

1. A lawn mower lifting device for use on wheeled lawn mowers comprises; a generally U-shaped main support frame having oppositely disposed equipment support portions, adjustable wheel engagement fittings extending from said equipment support portions, a handle extending from said main support frame, wheel assemblies on said main support frame, said adjustable wheel engagement fittings comprising, mounting tubes, oppositely disposed aligned extension tubes movably positioned from within said mounting tubes, means for selectively and incrementally locking said extension tubes within said mounting tubes, and stabilization means on said extension tubes engageable with said wheels of said lawn mower equipment.

2. The lawn mowing lifting device set forth in claim 1 wherein said wheel assemblies on said main support frame are in spaced relation to said adjustable wheel engagement fittings.

3. The lawn mowing lifting device set forth in claim 1 wherein said main support frame has a mounting sleeve between said equipment support portions.

4. The lawn mowing lifting device set forth in claim 1 wherein said handle extending from said main support frame and said equipment support portion are in angularly disposed relation to one another of less than 90 degrees.

5. The lawn mowing lifting device set forth in claim 3 wherein said mounting sleeve has an elongated handle section extending therefrom.

6. The lawn mowing lifting device set forth in claim 1 wherein said main support frame is of tubular metal.

7. The lawn mowing lifting device set forth in claim 1 wherein said adjustment wheel engagement fittings extend at right angles from said equipment support portions.

8. The lawn mowing lifting device set forth in claim 1 wherein each of said wheel assemblies comprises; an axle rod secured to said main frame, a wheel rotatably positioned on said axle rod in spaced relation to said main frame, and a brace element extending from main support frame to said axle rod.

9. The lawn mowing lifting device set forth in claim 1 wherein said stabilization means on said extension tube comprises; an apertured mounting sleeve with an angled iron secured thereto, said sleeve adjustably positioned on said extension tube and selectively locked in place by a locking pin extending through said apertured sleeve and aligned apertures in said extension tube.

10. A lawn mower lifting and support device for use on wheeled mowers comprises; a generally U-shaped main support frame having oppositely disposed aligned frame elements, said frame elements having equipment support portion and a horizontal frame support portion, a handle fitting extending from said horizontal frame support portion, wheel engagement fittings on the free ends of said equipment support portions, said wheel engagement fittings comprising, a mounting tube and an extension tube, means for adjustably positioning said extension tube within said mounting tube, wheel assemblies on said horizontal frame support portion, a handle removably secured to said handle fitting, said handle and said equipment support portions of said frame elements having an angular relationship of less than 90 degrees to one another.

11. The lawn mower lifting and support device set forth in claim 10 wherein said wheel assemblies on said horizontal frame portion are in spaced relation to said wheel engagement fittings.

12. The lawn mower lifting and support device set forth in claim 10 wherein said means for adjustably positioning said extension tube within said mounting tube comprises; a plurality of longitudinally spaced apertures through said extension tube, an aperture in said respective mounting tube, and locking pins extending through said selectively aligned apertures of said mounting tube and said extension tube.

13. The lawn mower lifting and support device set forth in claim 10 wherein said mounting tubes on said respective equipment support portions extend at right angles thereto.

14. The lawn mower lifting and support device set forth in claim 10 wherein said wheel assemblies on said horizontal frame support portion comprise; axle rods secured to said horizontal frame support portions, a brace extending between said axle rods and said horizontal frame support portion and resilient wheels rotatably positioned on the free ends on said respective axle rods.

15. The lawn mower lifting and support device set forth in claim 10 wherein said support frame elements are tubular and made of metal.

* * * * *